US006946794B2

(12) United States Patent
Yamamoto

(10) Patent No.: US 6,946,794 B2
(45) Date of Patent: Sep. 20, 2005

(54) LIGHT SOURCE DEVICE AND IMAGE READER

(75) Inventor: Norikazu Yamamoto, Yawata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 121 days.

(21) Appl. No.: 10/301,230

(22) Filed: Nov. 20, 2002

(65) Prior Publication Data

US 2003/0094563 A1 May 22, 2003

(30) Foreign Application Priority Data

Nov. 22, 2001 (JP) ..... 2001-357125

(51) Int. Cl.[7] ..... H01J 11/00; H01J 61/06; H01J 65/00; H01J 17/44

(52) U.S. Cl. ..... 313/607; 313/234; 313/594

(58) Field of Search ..... 313/234, 594, 313/607

(56) References Cited

U.S. PATENT DOCUMENTS

| | | | | |
|---|---|---|---|---|
| 4,342,940 A | * | 8/1982 | Mrusko et al. | 313/594 |
| 5,081,395 A | * | 1/1992 | Kikuchi et al. | 313/594 |
| 5,747,946 A | * | 5/1998 | Tyler | 315/291 |
| 6,097,155 A | | 8/2000 | Vollkommer et al. | |
| 6,310,442 B1 | | 10/2001 | Vollkommer et al. | |
| 6,621,218 B1 | * | 9/2003 | Matsumoto | 313/607 |
| 6,727,649 B1 | * | 4/2004 | Yano et al. | 313/607 |

FOREIGN PATENT DOCUMENTS

| | | |
|---|---|---|
| EP | 1 146 544 | 10/2001 |
| EP | 1 152 454 | 11/2001 |
| JP | 2-67554 | 5/1990 |
| JP | 5-242870 | 9/1993 |
| JP | 6-163005 | 6/1994 |
| JP | 6-163008 | 6/1994 |
| JP | 6-310098 | 11/1994 |
| JP | 10-112290 | 4/1998 |
| JP | 10-284008 | 10/1998 |
| JP | 2000-149878 | 5/2000 |
| JP | 2000-513872 | 10/2000 |
| JP | 2001-143662 | 5/2001 |
| JP | 2001-243921 | 9/2001 |
| JP | 2001-243922 | 9/2001 |
| JP | 2003-7251 | 1/2003 |
| WO | WO 99/54917 | 10/1999 |

* cited by examiner

*Primary Examiner*—Karabi Guharay
*Assistant Examiner*—Matt Hodges
(74) *Attorney, Agent, or Firm*—Hamre, Schumann, Muellar & Larson, P.C.

(57) ABSTRACT

A light source device includes at least one discharge tube, a discharge medium sealed inside the discharge tube, and first and second electrodes for exciting the discharge medium. The first electrode is arranged inside the discharge tube. The second electrode is in contact with an outer surface of the discharge tube at a plurality of linear contact portions. The plurality of linear contact portions are substantially parallel with each other. Thus, a light source device is provided in which the occurrence of constricted discharge can be suppressed readily.

14 Claims, 16 Drawing Sheets

LIGHT SOURCE DEVICE AND IMAGE READER

BACKGROUND OF THE INVENTION

1. Field of the Invention

The present invention relates generally to a light source device including a discharge tube, a discharge medium sealed inside the discharge tube, and electrodes for exciting the discharge medium, and also relates to an image reader employing the light source device.

2. Related Background Art

The development of discharge lamp devices in each of which a discharge tube and electrodes arranged inside and/or outside the discharge tube are provided has been promoted. Discharge lamps in each of which an inner electrode arranged inside a discharge tube and an outer electrode formed on an outer surface of the discharge tube are provided with view to stabilizing the discharge state and improving the light emission efficiency are used widely. These discharge lamps are caused to emit light by applying a voltage across the inner electrode and the outer electrode.

As such a discharge lamp, a discharge lamp device disclosed in JP6(1994)-163005A is well known. FIG. 14 schematically illustrates the conventional discharge lamp device. The conventional discharge lamp device 900 includes an inner electrode 901, an outer electrode 902, and a discharge tube 903. Inside the discharge tube 903, a rare gas is sealed. The inner electrode 901 is arranged inside the discharge tube 903, and the outer electrode 903, which is in a linear form, is arranged on an outer surface of the discharge tube 903. The inner and outer electrodes 901 and 902 are connected with a driving circuit 904. The application of a voltage to these electrodes by the driving circuit 904 causes the discharge lamp device 900 to emit light.

JP 10(1998)-112290A discloses a discharge lamp device having a spiral outer electrode formed on an outer surface of a discharge tube.

To obtain light emission with high brightness in a discharge lamp device, it is effective to raise the gas pressure inside a discharge tube or to increase an input voltage. However, the foregoing conventional discharge lamp devices have a problem that a rise of the gas pressure or an increase in the input voltage tends to cause constricted discharge. In the case where the discharge is constricted, it is impossible to obtain a brightness commensurate with input power, decreasing the light emission efficiency. Furthermore, in the case where the discharge is constricted, the problem of a temperature rise in the tube wall of the discharge tube occurs.

The causes of the constriction of the discharge are described below. FIGS. 15A, 16A, and 17A are views schematically illustrating discharge states. FIG. 15B is a schematic cross-sectional view taken along a line XIVB—XIVB in FIG. 15A. FIG. 16B is a schematic cross-sectional view taken along a line XVB—XVB in FIG. 16A. FIG. 17B is a schematic cross-sectional view taken along a line XVIB—XVIB in FIG. 17A.

In the case where the gas pressure inside the discharge tube 903 is not more than 1 kPa, upon input of power to the discharge lamp device 900, discharge starts at a portion where the inner and outer electrodes 901 and 902 are in the closest proximity with each other. In the foregoing portion, constricted discharge occurs once, but since a discharge substance inside the discharge tube 903 is present in a low amount and hence the mean free path of electrons is sufficiently long, the discharge path tends to expand. As a result, as shown in FIGS. 15A and 15B, diffused discharge occurs with a central portion of the discharge tube 903 as the center of diffusion. In the diffused discharge state, the discharge medium can be excited efficiently in a wide region inside the discharge tube 903, thereby improving the excitation efficiency, and increasing the light output relative to the input power.

As the gas pressure inside the discharge tube 903 rises above 1 kPa, the discharge substance inside the discharge tube 903 increases, thereby shortening the mean free path of electrons. Therefore, the discharge gradually is constricted to one point so that the discharge is maintained. Besides, as the gas pressure rises, the resistance in a portion in the vicinity of the outer electrode 902 becomes lower than a resistance in the central portion of the discharge tube 903. This causes the discharge to be constricted along the outer electrode 902, as shown in FIGS. 16A and 16B. Here, since the constricted discharge excites only a part of the discharge medium, the excitation efficiency decreases, thereby decreasing the light output. Furthermore, since energy not used in the excitation, which is regarded as energy loss, is radiated mainly in the form of heat, this causes the temperature of the discharge tube to rise. In this state, though the light output is stable, the light output relative to the input power is saturated, thereby increasing heat generation.

Furthermore, as the gas pressure is raised further, discharge occurs selectively in a portion in the vicinity of the outer electrode 902 and having a low gas concentration. Therefore, as shown in FIGS. 17A and 17B, the discharge meanders and is destabilized. As a result, the light amount of the discharge lamp device 900 is destabilized, which makes it difficult to obtain a brightness commensurate with the input power.

SUMMARY OF THE INVENTION

Therefore, with the foregoing in mind, it is an object of the present invention to provide a light source device in which the occurrence of constricted discharge can be suppressed readily, and to provide an image reader employing the light source device.

To achieve the foregoing object, a light source device of the present invention includes at least one discharge tube, a discharge medium sealed inside the discharge tube, and first and second electrodes for exciting the discharge medium. The first electrode is arranged inside the discharge tube. The second electrode is in contact with an outer surface of the discharge tube at a plurality of linear contact portions. The plurality of linear contact portions are substantially parallel with each other. In this light source device, the constriction of discharge can be suppressed readily. Furthermore, by varying the shape of the contact portion, the light emission intensity distribution can be controlled easily. It should be noted that "substantially parallel" means that an angle formed between two linear contact portions is not more than 10°. Furthermore, cases meant by the "contact of the second electrode with an outer surface of the discharge tube" include a case where the second electrode and the discharge tube are in contact with each other via a dielectric or the like. The "contact" herein means that no air space is present between two members.

In the foregoing light source device, the second electrode may include a plurality of linear electrodes, and the plurality of linear electrodes may be arranged on the outer surface of the discharge tube so as to be substantially parallel with each other.

In the foregoing light source device, the plurality of linear contact portions may be arranged so as to be substantially parallel with a tube axis of the discharge tube.

In the foregoing light source device, the plurality of linear contact portions may be arranged in a spiral form on the outer surface of the discharge tube.

In the foregoing light source device, a space between two selected from the plurality of linear contact portions may be not less than a wall thickness of the discharge tube.

In the foregoing light source device, a space between two selected from the plurality of linear contact portions may decrease with increasing proximity to the first electrode.

In the foregoing light source device, a space between two selected from the plurality of linear contact portions may be minimized at the center of the discharge tube.

In the foregoing light source device, the second electrode may be in contact with the outer surface of the discharge tube via a dielectric.

In the foregoing light source device, the first electrode may include a protrusion that protrudes toward the second electrode.

In the foregoing light source device, the discharge medium may contain at least one selected from xenon gas, krypton gas, argon gas, neon gas, and helium gas.

In the foregoing light source device, the discharge medium further may contain mercury.

In the foregoing light source device, a pressure inside the discharge tube may be not less than 6.65 kPa and not more than 26.6 kPa.

The foregoing light source device further may include a phosphor layer formed on an inner surface of the discharge tube.

In the foregoing light source device, a surface of the first electrode may be covered with a dielectric.

An image reader of the present invention is an image reader for reading an image, and includes a light source device for emitting light, and an optical system for condensing and detecting the light reflected by the image. In this image reader, the light source device is the above-described light source device of the present invention.

DETAILED DESCRIPTION OF THE INVENTION

Figure 1:
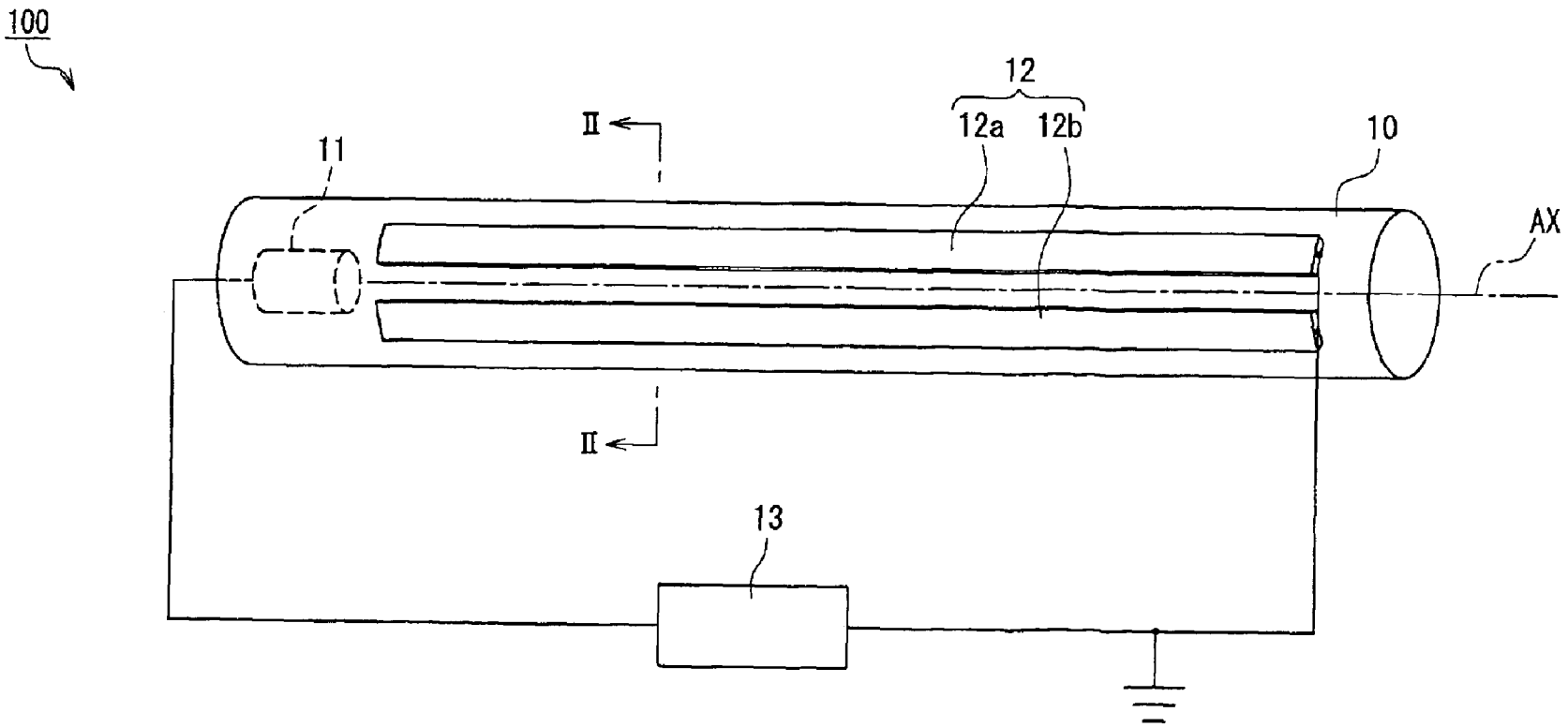
FIG. 1 is a view schematically illustrating an example of a light source device of the present invention.

The following will describe embodiments of the present invention while referring to the drawings. It should be noted that in the following description, the same members are designated by the same reference numerals and duplicate descriptions of the same are omitted in some cases.

Embodiment 1

Figure 2:
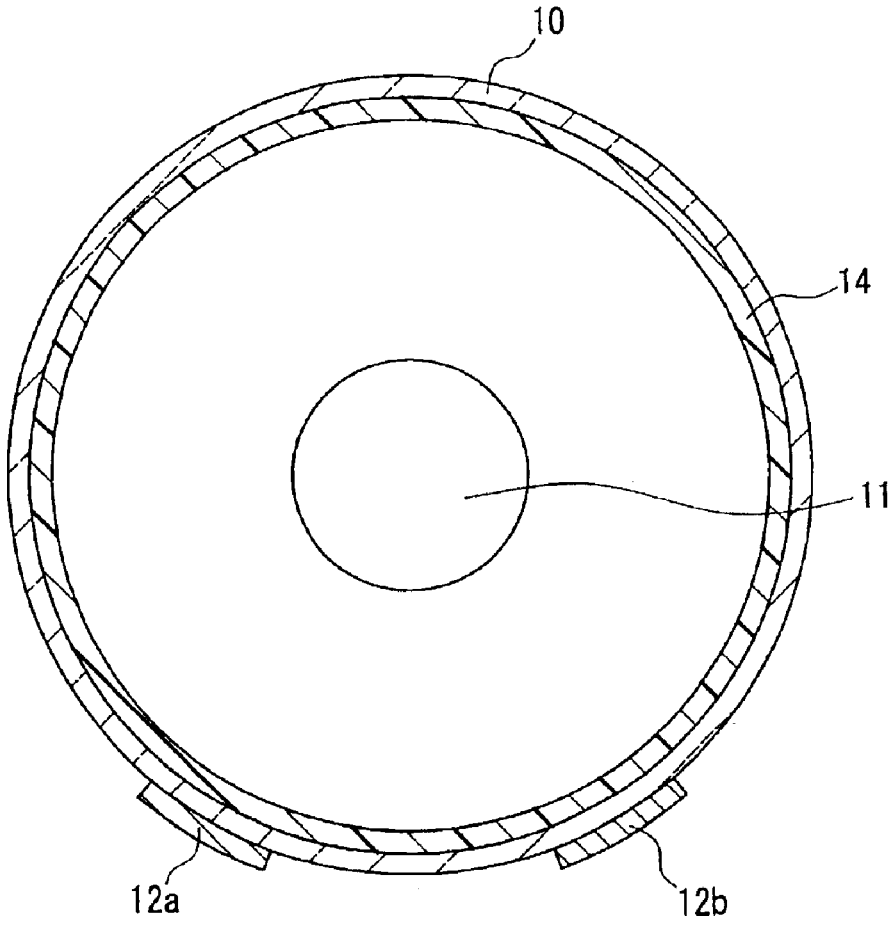
FIG. 2 is a cross-sectional view of the light source device shown in FIG. 1.

In Embodiment 1, a discharge lamp device as an example of a light source device of the present invention is described. FIG. 1 is a schematic perspective view of a light source device 100 of Embodiment 1. FIG. 2 is a cross-sectional view of the light source device 100 taken along a line II—II in FIG. 1.

The light source device 100 includes a discharge tube 10, a first electrode (inner electrode) 11, and a second electrode (outer electrode) 12. The first and second electrodes 11 and 12 are connected to a driving circuit 13.

The discharge tube 10 is made of a transparent material, for instance, borosilicate glass. Alternatively, the discharge tube 10 may be made of quartz glass, soda-lime glass, or lead glass. The discharge tube 10 may include a dielectric layer (for instance, a resin layer) arranged on an outer surface thereof. To form the dielectric layer, it is possible to use, for instance, a multilayer film made of a polyester-based resin, or a thin film made of titanium oxide or silicon oxide. The glass tube used for forming the discharge tube 10 normally has an outside diameter of approximately 1.2 mm to 15 mm. A distance between the outer surface and an inner surface of the glass tube, that is, a wall thickness of the glass tube, normally is approximately 0.15 mm to 1.0 mm. The discharge tube 10 normally has a length of approximately 30 mm to 500 mm. In the case where a dielectric layer is formed on a surface of the glass tube, the dielectric layer normally has a thickness of approximately 0.5 $\mu$m to 100 $\mu$m. It should be noted that the discharge tube 10 does not necessarily have a straight shape, but may have another shape. For instance, it may be formed in a shape of the letter L or the letter U, or in a rectangular shape.

The discharge tube 10 is sealed, and a discharge medium (not shown) is encapsulated in the discharge tube (this also applies to Embodiments described later). A rare gas can be used as the discharge medium used in the light source device 100. The rare gas used therein can be at least one selected from krypton gas, argon gas, helium gas, and xenon gas. The discharge medium may contain mercury, in addition to the rare gas. It should be noted, however, that in the case where the discharge medium does not contain mercury, it is possible to prevent the light emission efficiency from varying in response to a change in a mercury vapor pressure that is caused by a change of the ambient temperature. Besides, an ultraviolet light radiated from xenon gas has a wavelength in proximity to a wavelength of an ultraviolet light radiated from mercury. Therefore, the use of xenon gas as the rare gas has an advantage in that the same phosphor as that used in a fluorescent lamp employing mercury can be used. It should be noted that the above-described discharge media are applicable as the discharge media in Embodiments described later.

As shown in FIG. 2, a phosphor layer 14 is formed on an inner surface of the discharge tube 10. The phosphor layer 14 is formed so as to convert a wavelength of light emitted by the discharge medium. By altering the materials of the phosphor layer 14, light with various wavelengths can be obtained. For example, white light, red, green, and blue (RGB) lights, etc. can be obtained. The phosphor layer 14 can be made of a material generally used in a discharge lamp or a plasma display.

The first electrode 11 is arranged inside the discharge tube 10. The first electrode 11 can be made of a metal, for instance, tungsten or nickel. A surface of the first electrode 11 may be covered with a metal oxide layer made of, for instance, cesium oxide, magnesium oxide, barium oxide, etc. The use of such a metal oxide layer allows an illumination start voltage to decrease, thereby preventing the electrode from being degraded by ion impact. Alternatively, the surface of the first electrode 11 may be covered with a dielectric layer (for instance, a glass layer). The use of such a dielectric layer covering the first electrode 11 makes it possible to suppress current upon discharge. This suppresses the continuous flow of current upon discharge, thereby stabilizing the discharge.

The second electrode 12 is formed outside the discharge tube 10. The second electrode 12 is made of a conductive material. For instance, to form the second electrode 12, a tape or a conductive wire made of a metal (e.g., aluminum, copper) may be used. Alternatively, the second electrode 12 may be made of a metal paste containing a metal powder (for example, silver powder) and a resin.

The second electrode 12 is in contact with an outer surface of the discharge tube 10 at a plurality of linear contact portions thereof. Alternatively, the second electrode 12 may be in contact with the outer surface of the discharge tube 10 via a dielectric. The foregoing plurality of linear contact portions are arranged substantially in parallel with each other. In the following description, a case in which the second electrode 12 includes a plurality of linear electrodes in contact with the outer surface of the discharge tube 10 will be described mainly. However, as an example described in Embodiment 5, the second electrode of an optical device of the present invention does not necessarily include linear electrodes (this also applies to Embodiments described later). In the following description, "contact portion" may replace "linear electrode".

The second electrode 12 includes a plurality of linear electrodes arranged substantially in parallel with each other. The linear electrode normally has a length of not less than ten times the width thereof, for instance, not less than 100 times the width. FIG. 1 illustrates the second electrode 12 including linear electrodes 12*a* and 12*b*. The linear electrodes 12*a* and 12*b* are substantially parallel with each other. It should be noted that "substantially parallel" means that an angle formed between the linear electrode 12*a* and the linear electrode 12*b* is not more than 10°. A space between the linear electrodes 12*a* and 12*b* preferably is not less than the wall thickness of the discharge tube 10, and not more than three times the wall thickness of the discharge tube 10. By setting the space therebetween to be not less than the wall thickness of the discharge tube 10, the constriction of discharge can be suppressed particularly well. Furthermore, by setting the space to be not more than three times the wall thickness of the discharge tube 10, the discharge can be stabilized. The width of the linear electrodes preferably is set so that a sum of widths of all the linear electrodes is not less than twice and not more than ten times the wall thickness of the discharge tube 10. The linear electrodes 12*a* and 12*b* both are arranged substantially in parallel with a tube axis AX of the discharge tube 10. It should be noted that the second electrode 12 may include three or more linear electrodes.

The linear electrodes 12*a* and 12*b* are connected with each other via an electric line, and both are connected with the driving circuit 13. There is no particular limitation on a position where the linear electrodes 12*a* and 12*b* are connected, and they may be connected in the vicinity of the first electrode 11. As shown in FIG. 1, the second electrode 12 preferably is connected with a ground potential.

As the driving circuit 13, a circuit generally used in a discharge lamp device can be used. The voltage applied across the first and second electrodes 11 and 12 may be, for instance, a rectangular-waveform voltage, and may have an inverted polarity, which however is not a requirement.

Upon application of a voltage across the first and second electrodes 11 and 12 by the driving circuit 13, glow discharge occurs inside the discharge tube 10, which excites the discharge medium (for instance, xenon and/or mercury). When the excited discharge medium makes a transition to a ground state, the discharge medium emits ultraviolet light. The ultraviolet light excites a phosphor of the phosphor layer 14, and the excited phosphor emits visible light.

In the light source device 100 of the present invention and the conventional light source device, a gas pressure inside the discharge tube was varied, and a brightness on the surface of the discharge tube that varied in response was measured. In the conventional light source device, the second electrode included only one linear electrode. In contrast, in the light source device of the present invention, the second electrode included two linear electrodes. The configurations of the foregoing two light source devices were made completely identical to each other in the other aspects. Xenon gas was used as the discharge medium. The discharge tube 10 had an outside diameter of 4 mm, an inside diameter of 3.4 mm, a length in the tube axial direction of 220 mm, and a tube wall thickness of 0.3 mm. In the conventional light source device, one linear electrode (2 mm in width, 252 mm in length) was used as the outer electrode. In contrast, in the light source device of the present invention, two linear electrodes (1 mm in width, 252 mm in length) arranged with a space of 0.5 mm therebetween, were used as the outer electrode. An area of the outer electrode of the light source device of the present invention and an area of the outer electrode of the conventional light source device were set to be equal to each other.

A rectangular-waveform voltage of 2 kV with a pulse width of 5 $\mu$sec and a frequency of 30 kHz was applied by the driving circuit 13. The measurement of brightness was carried out in a portion where the outer electrode was not formed, so that the influence of reflection by the outer electrode was avoided.

Figure 3:
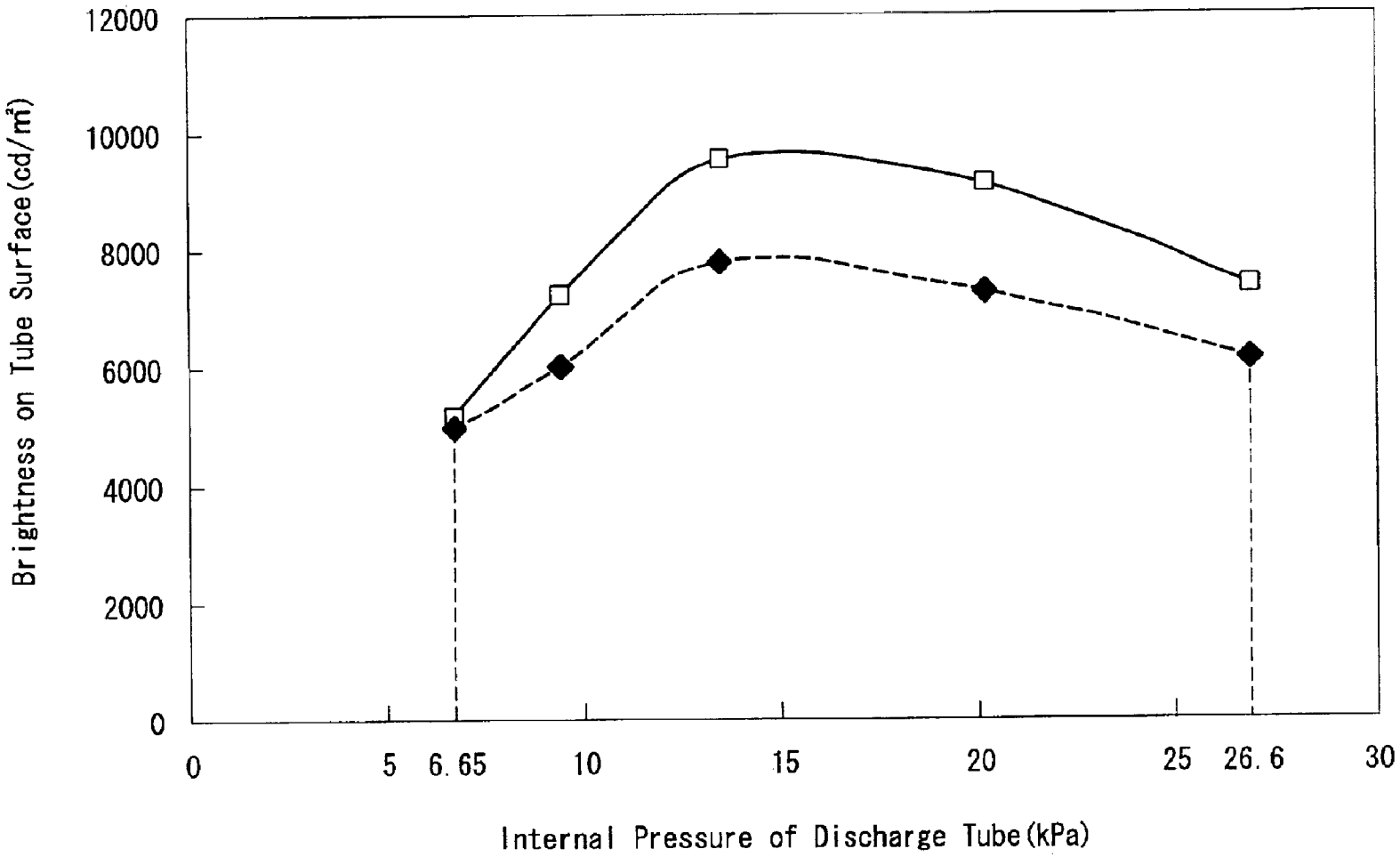
FIG. 3 is a graph showing the relationship between the gas pressure inside a discharge tube and the brightness on a tube surface, regarding the light source device of the present invention and a conventional light source device.
Figure 4:
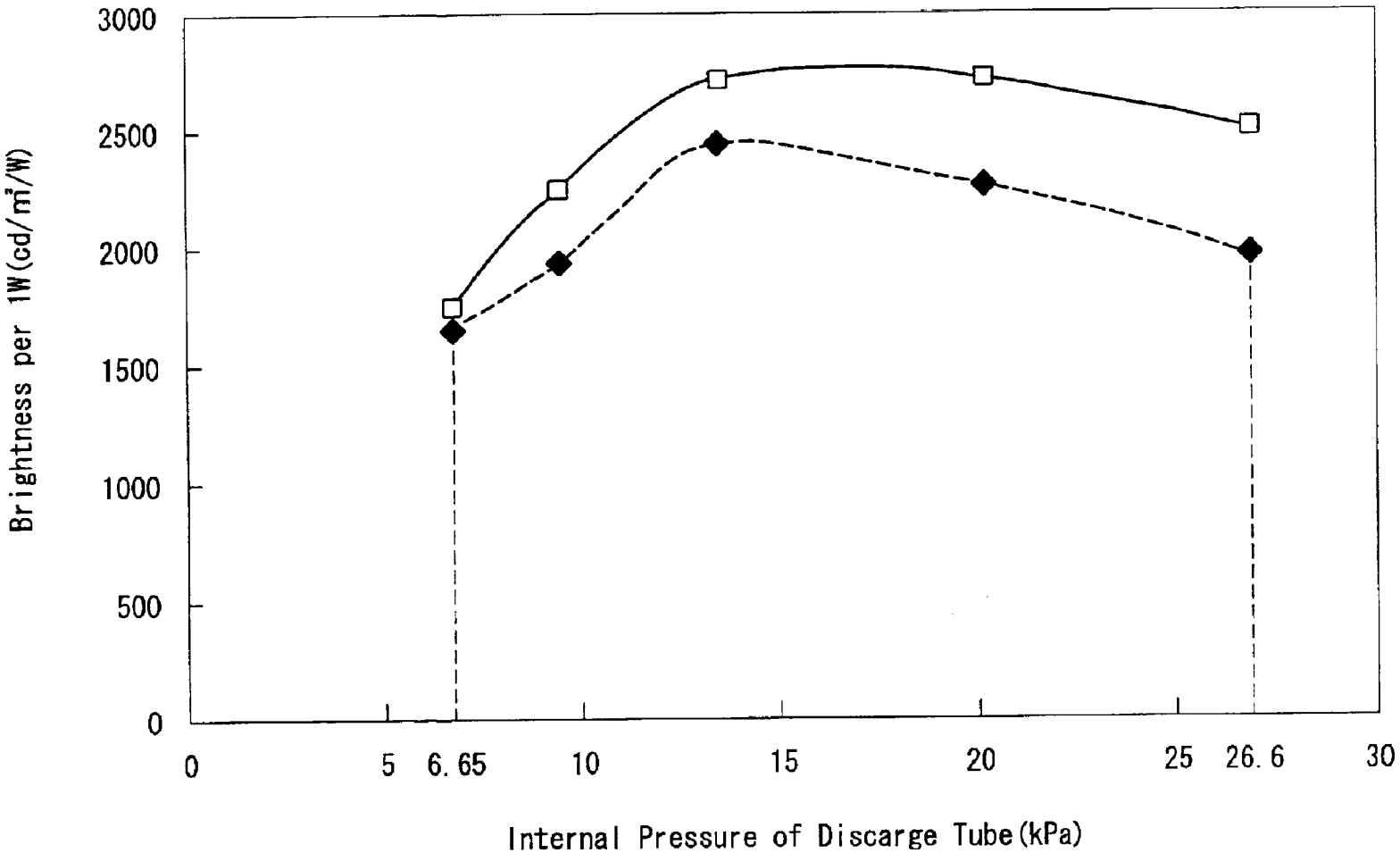
FIG. 4 is a graph showing the relationship between the gas pressure inside the discharge tube and the brightness per 1 W, regarding the light source device of the present invention and the conventional light source device.

The relationship between the pressure inside the discharge tube (pressure of the xenon gas) and the brightness on the tube surface is shown in FIG. 3. The relationship between the pressure inside the discharge tube and the brightness per 1W of input power is shown in FIG. 4. In FIGS. 3 and 4, a solid line indicates the result of the light source device of the present invention, and a dotted line indicates the result of the conventional light source device.

As is seen in FIG. 3, in the conventional light source device, a rise of the sealing pressure caused an increase in the brightness only to as low as approximately 7800 (cd/m$^2$). Then, a further rise of the pressure caused significant constriction of discharge, thereby decreasing the brightness.

In contrast, in the light source device of the present invention, in the case where the pressure of the xenon gas was approximately 13.3 kPa, a brightness in the proximity of 10000 (cd/m$^2$) was obtained. Furthermore, even in the case where the pressure of the xenon gas was set to be approximately 26.6 kPa, a brightness at the same level as that of the highest brightness of the conventional light source device (7512 (cd/m$^2$)) was obtained. Furthermore, as is seen in FIG. 4, in a range of 6.65 kPa to 26.6 kPa in which the experiments were carried out, the light emission efficiency was improved. The light emission efficiency was improved significantly on the high pressure side in particular. As the pressure rose, the brightness decreased after having a peak when the pressure was in the vicinity of 13.3 kPa. This is because the diffused discharge made a gradual transition to the constricted discharge. It should be noted that with a gas pressure exceeding 26.6 kPa, streaked discharge occurred throughout the entire discharge tube, thereby becoming a constricted discharge state.

Figure 5:
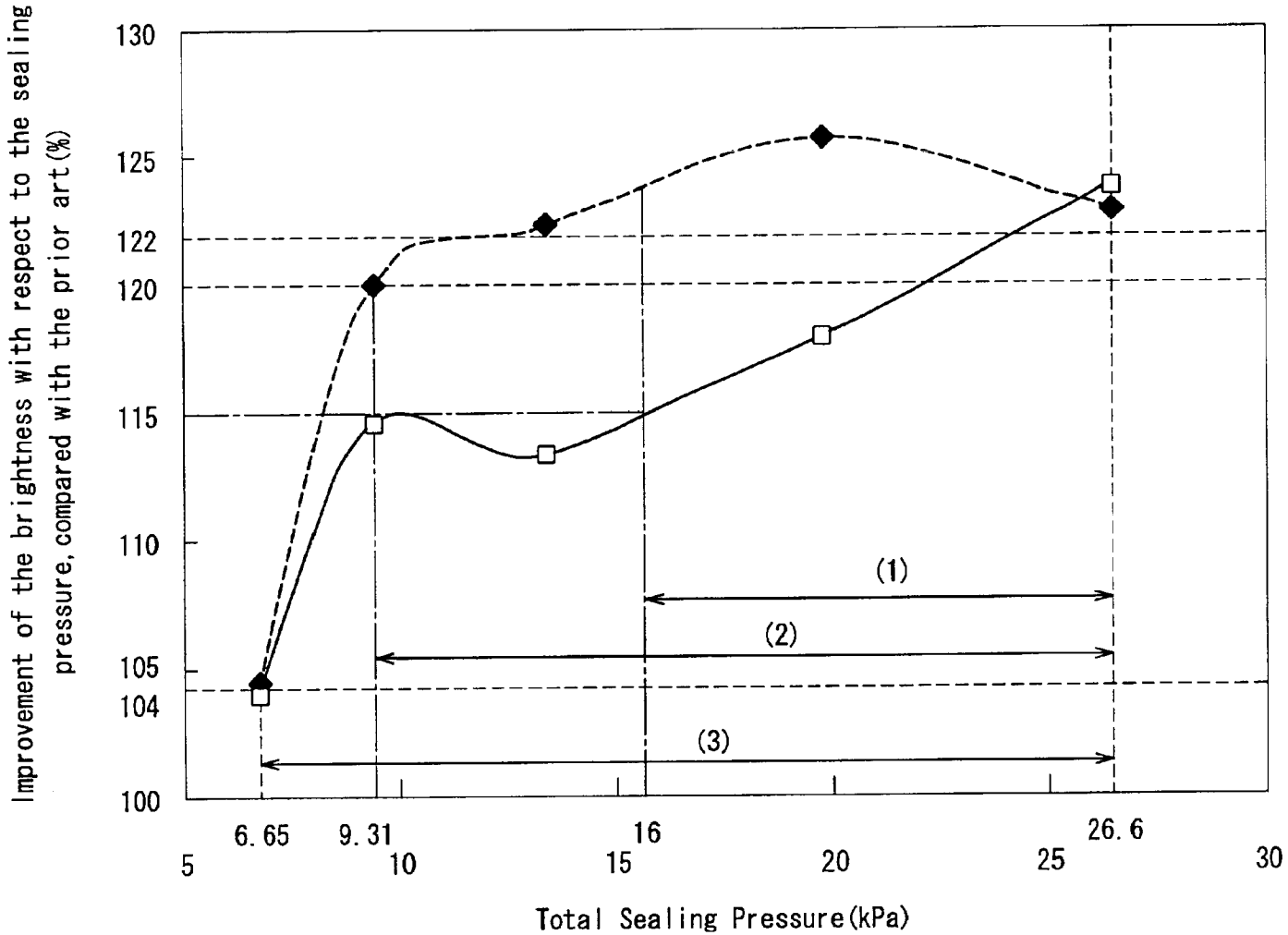
FIG. 5 is a graph in which the brightness of the light source device of the present invention is compared with the brightness of the conventional light source device.

FIG. 5 illustrates the brightness of the light source device of the present invention relative to the brightness of the conventional light source device as 100%. In FIG. 5, a solid line indicates a brightness per 1W, and a dotted line indicates a brightness on the tube surface. The horizontal axis indicates a total sealing pressure in the discharge tube (herein equivalent to the pressure of the xenon gas).

In the case where the pressure of the xenon gas was less than 6.65 kPa, the brightness did not improve as compared with that of the conventional light source device. In the case where the pressure exceeded 26.6 kPa, the sealing pressure was too high to stabilize the discharge. Therefore, in the light source device of the present invention, the gas pressure inside the discharge tube preferably is set to be not less than 6.65 kPa and not more than 26.6 kPa (range (3) in FIG. 5), more preferably not less than 9.3 kPa and not more than 26.6 kPa (range (2) in FIG. 5), particularly preferably not less than 16 kPa and not more than 26.6 kPa (range (1) in FIG. 5).

Embodiment 2

Figure 6:
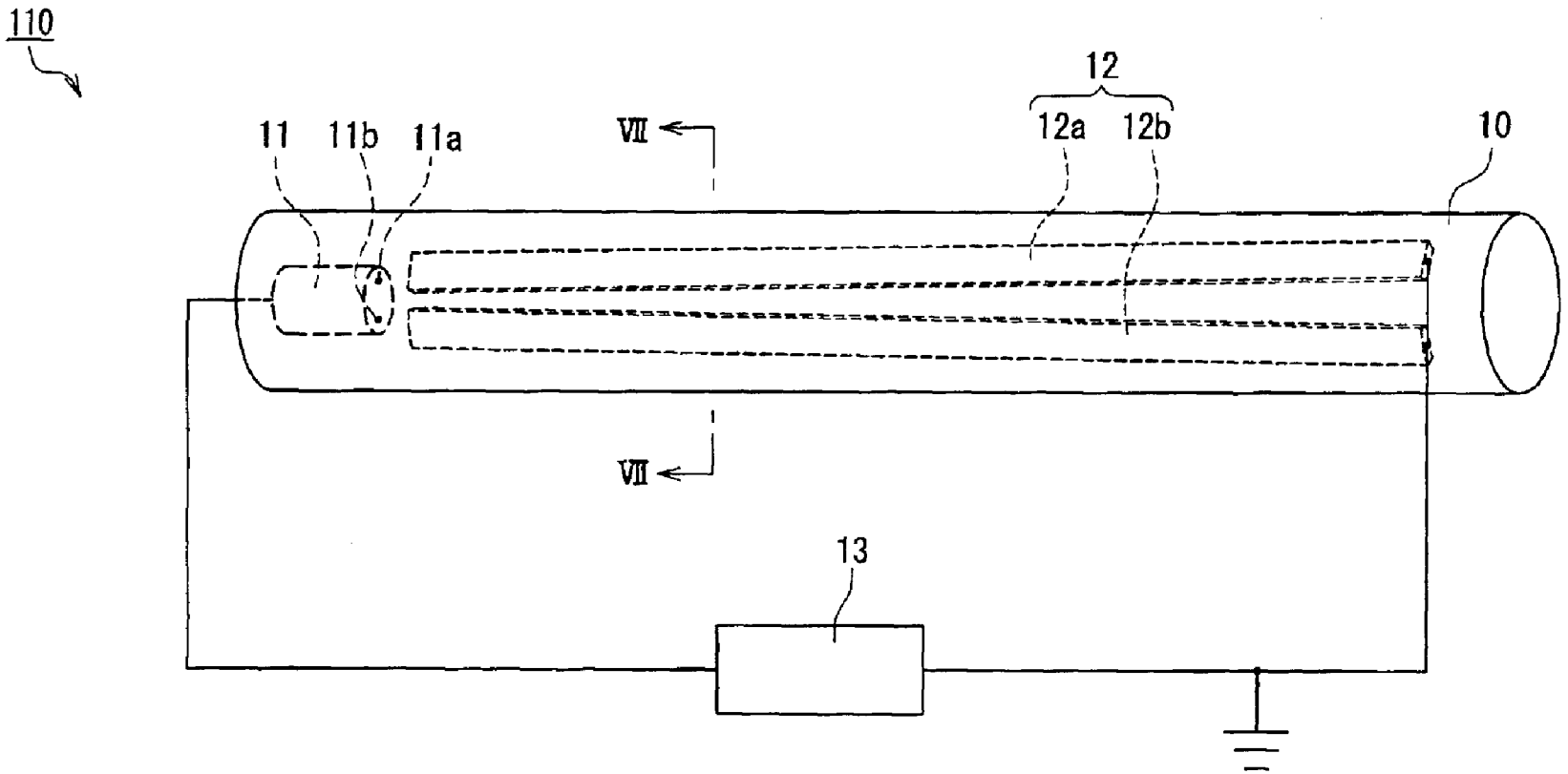
FIG. 6 is a view schematically illustrating another example of a light source device of the present invention.
Figure 7:
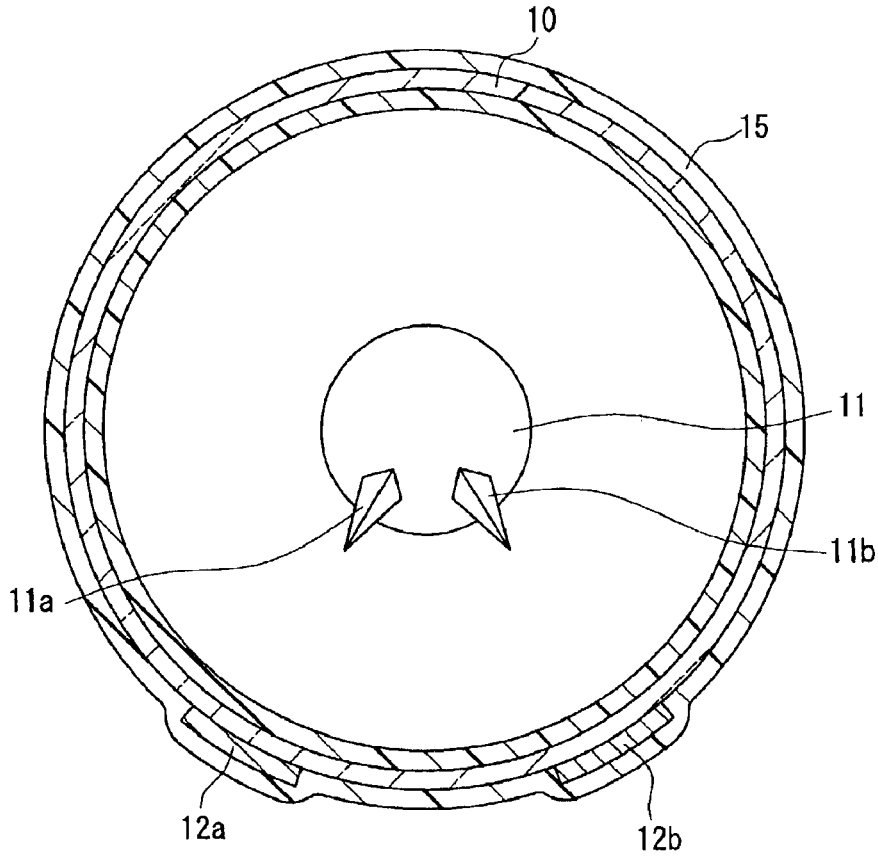
FIG. 7 is a cross-sectional view of the light source device shown in FIG. 6.

In Embodiment 2, another example of a light source device of the present invention is described. FIG. 6 is a schematic perspective view of a light source device 110 according to Embodiment 2. FIG. 7 is a cross-sectional view of the light source device 110 taken along a line VII—VII in FIG. 6.

A difference of the light source device 110 from the light source device 100 is the arrangement of the linear electrodes 12*a* and 12*b*. In the light source device 110, the linear electrodes 12*a* and 12*b* are arranged not completely but substantially in parallel with each other. More specifically, the linear electrodes 12*a* and 12*b* are arranged so that a space therebetween decreases with increasing proximity to the first electrode 11. An angle formed between the linear electrodes 12*a* and 12*b* is, for instance, not less than 0.1° and not more than 0.5°.

A rise of the sealed gas pressure with view to improving brightness causes a path of discharge to be blocked by the sealed gas, thereby decreasing a potential of the discharge with decreasing proximity to the first electrode 11. Therefore, in some cases, the brightness decreases with decreasing proximity to the first electrode 11. To correct such bias of the brightness, the linear electrodes are arranged in the light source device 110 as shown in FIG. 6. This configuration improves the distribution of the brightness, allowing uniform light emission to be obtained readily. It should be noted that for decreasing the brightness in the vicinity of the first electrode 11, a space between the linear electrodes 12*a* and 12*b* in the vicinity of the first electrode 11 preferably is narrowed as compared with the wall thickness of the discharge tube.

As shown in FIG. 7, the light source device of the present invention may include an insulation film 15 that is formed so as to cover the linear electrodes 12*a* and 12*b*. The insulation film 15 can be made of, for instance, polyethylene terephthalate or a fluorine resin. By covering the linear electrodes 12*a* and 12*b* with the insulation film 15, it is possible to obtain a safer light source device.

Furthermore, the first electrode 11 of the light source device of the present invention may include protrusions at an end thereof, the protrusions protruding toward the linear electrodes. The first electrode 11 of the light source device 110 shown in FIG. 7 includes protrusions 11*a* and 11*b* that protrude toward the linear electrodes 12*a* and 12*b*, respectively. Such protrusions allow discharge to be generated uniformly between the first electrode 11 and the linear electrode 12*a* and between the first electrode 11 and the linear electrode 12*b*, thereby readily suppressing the constriction of discharge in particular. It should be noted that the number of protrusions is not necessarily equal to the number of linear electrodes.

Embodiment 3

Figure 8:
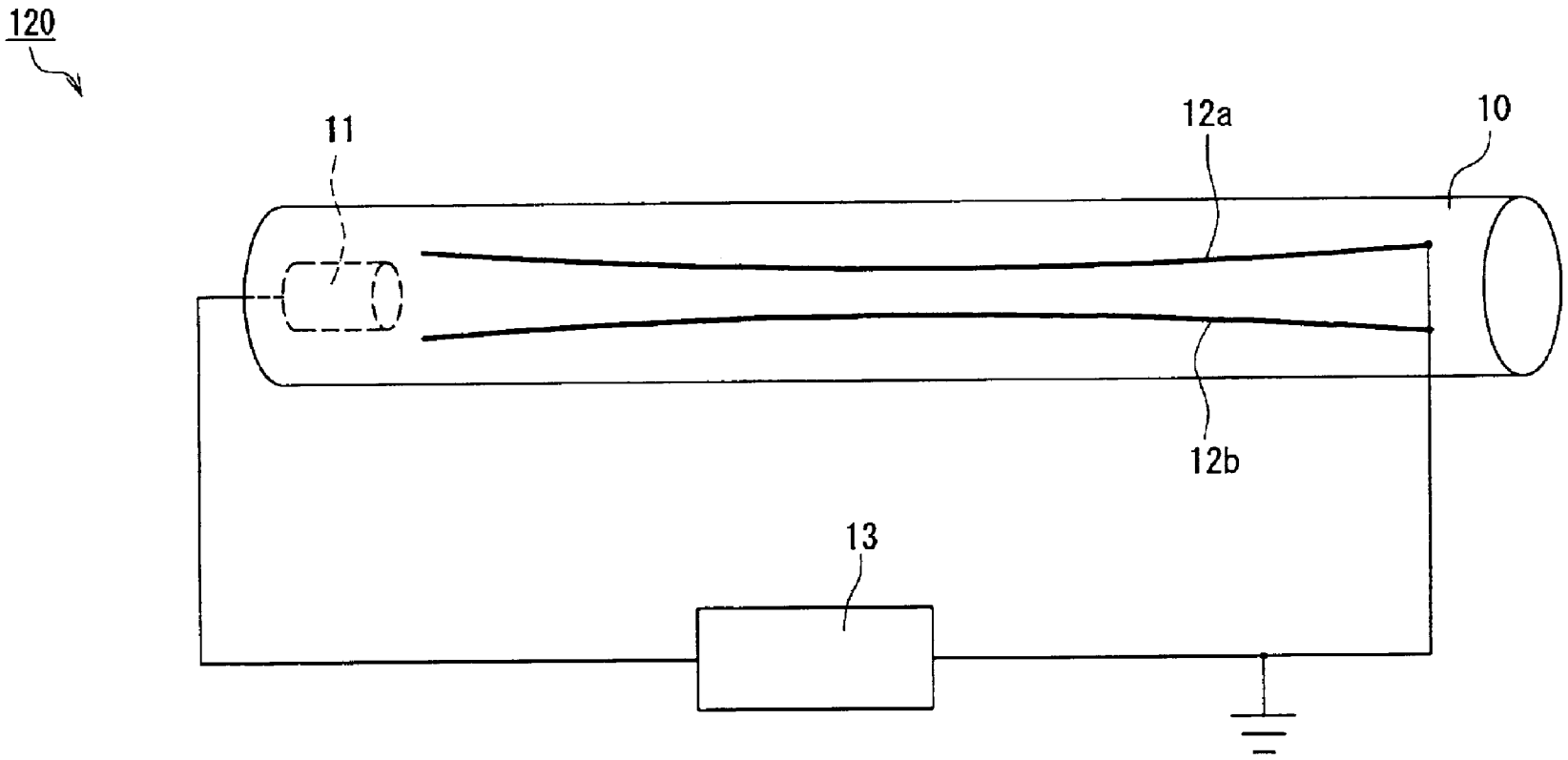
FIG. 8 is a view schematically illustrating still another example of a light source device of the present invention.

In Embodiment 3, still another example of a light source device of the present invention is described. FIG. 8 schematically illustrates a light source device 120 according to Embodiment 3. The light source device 120 is identical to the light source device 100 shown in FIG. 1 except for the arrangement of the linear electrodes. The descriptions of parts other than the linear electrodes are omitted herein.

Linear electrodes 12*a* and 12*b* of the light source device 120 are formed so that a space therebetween is minimized approximately at the center of the discharge tube 10. The space preferably is not more than the wall thickness of the discharge tube 10 at the position where the space is minimized. The space preferably is not more than four times the wall thickness of the discharge tube 10 at a position where the space is maximized. The linear electrodes 12*a* and 12*b* are arranged substantially in parallel with each other.

Such a light source is suitable as a light source of an image reader for use in a copying machine or a facsimile. An example of an image reader employing the light source device according to Embodiment 3 will be described in Embodiment 6.

Embodiment 4

Figure 9:
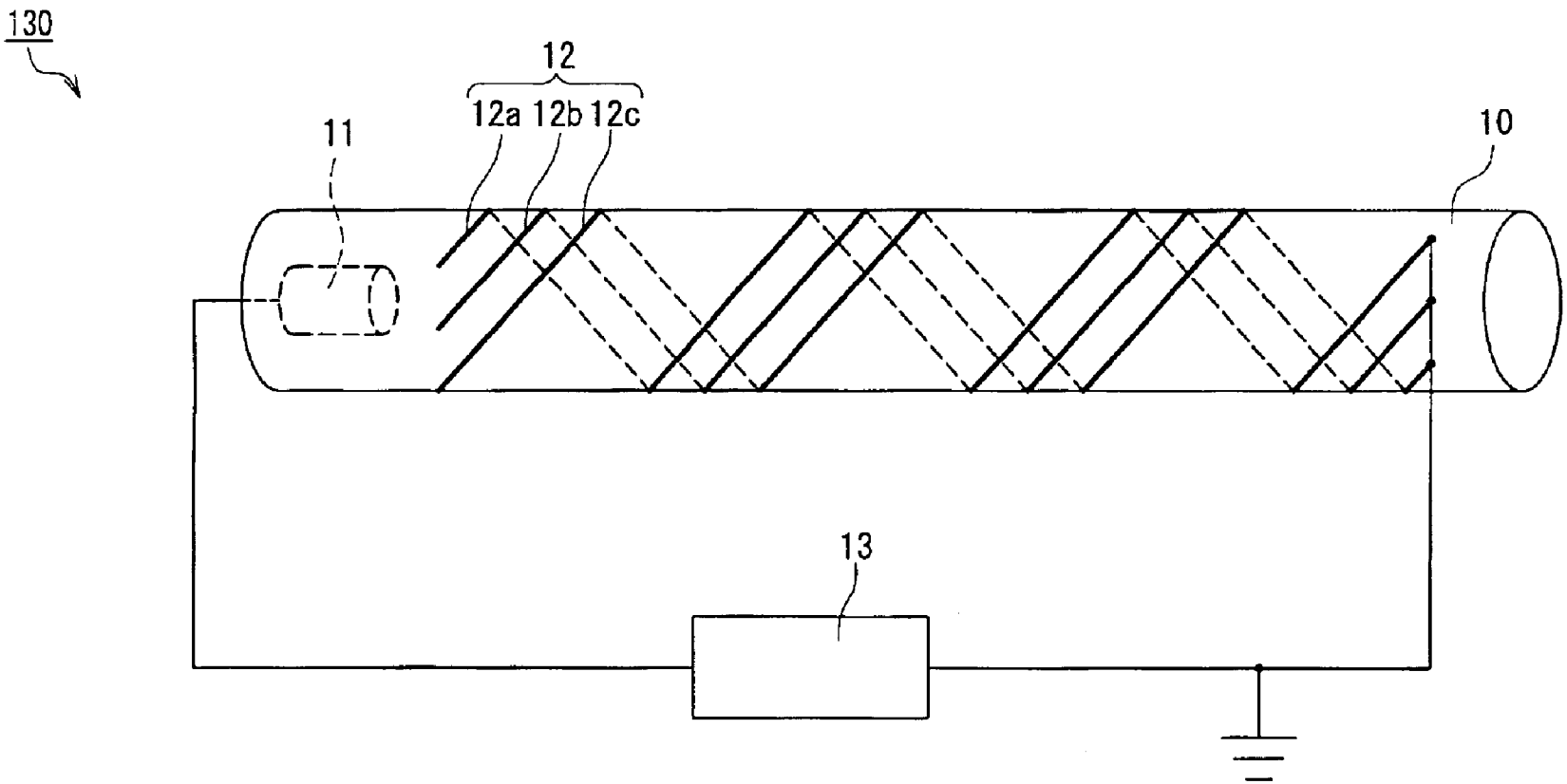
FIG. 9 is a view schematically illustrating still another example of a light source device of the present invention.

In Embodiment 4, still another example of a light source device of the present invention is described. FIG. 9 schematically illustrates a light source device 130 according to Embodiment 4. The light source device 130 is identical to the light source device 100 shown in FIG. 1 except for the arrangement of linear electrodes. The descriptions of parts other than the linear electrodes are omitted herein.

The second electrode 12 of the light source device 130 includes linear electrodes 12*a*, 12*b*, and 12*c*. The linear electrodes 12*a*, 12*b*, and 12*c* are arranged substantially in parallel with each other. The linear electrodes are formed in a spiral form on the outer surface of the discharge tube 10. This configuration allows discharge to be generated uniformly in a circumferential direction of the discharge tube 10, making it possible to obtain light emission with more uniform distribution of brightness.

Embodiment 5

Figure 10:
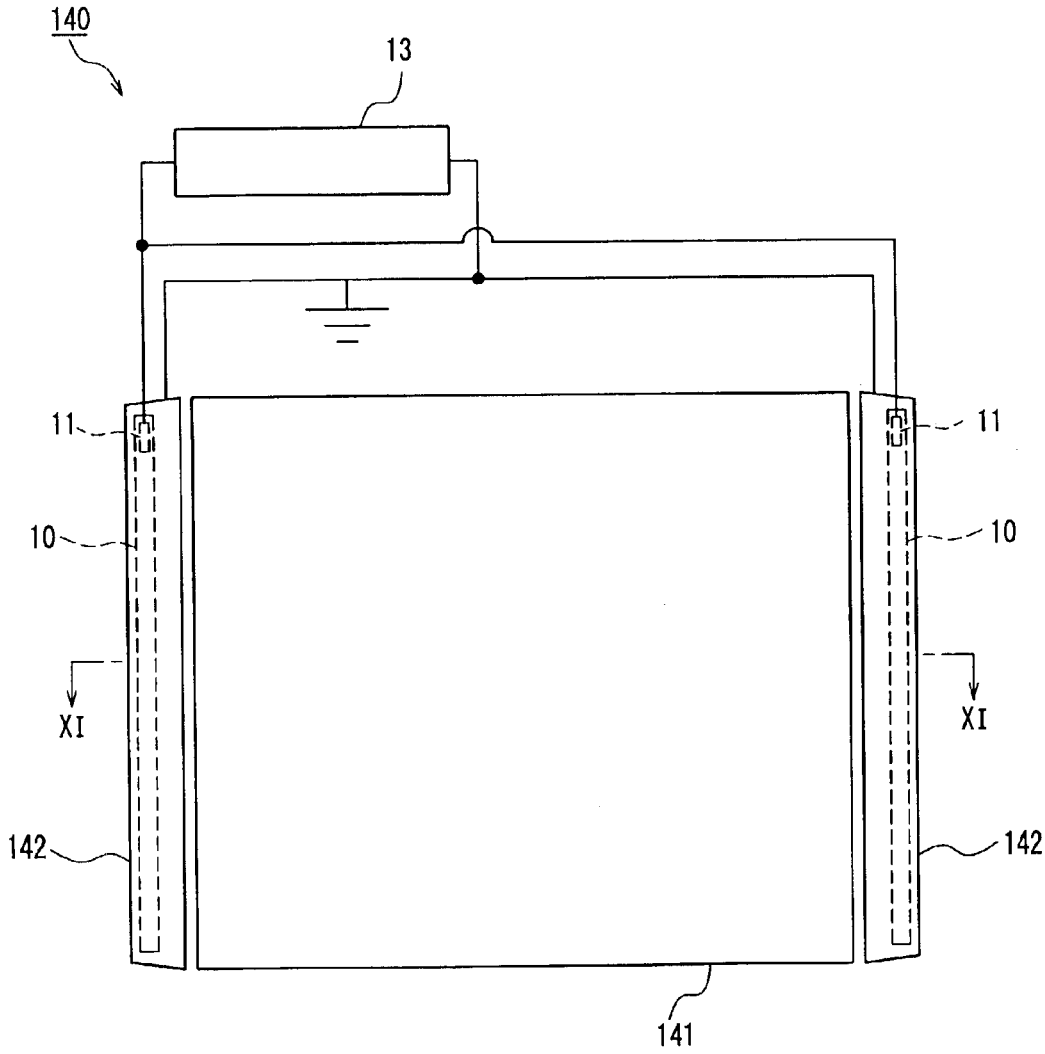
FIG. 10 is a view schematically illustrating still another example of a light source device of the present invention.
Figure 11:
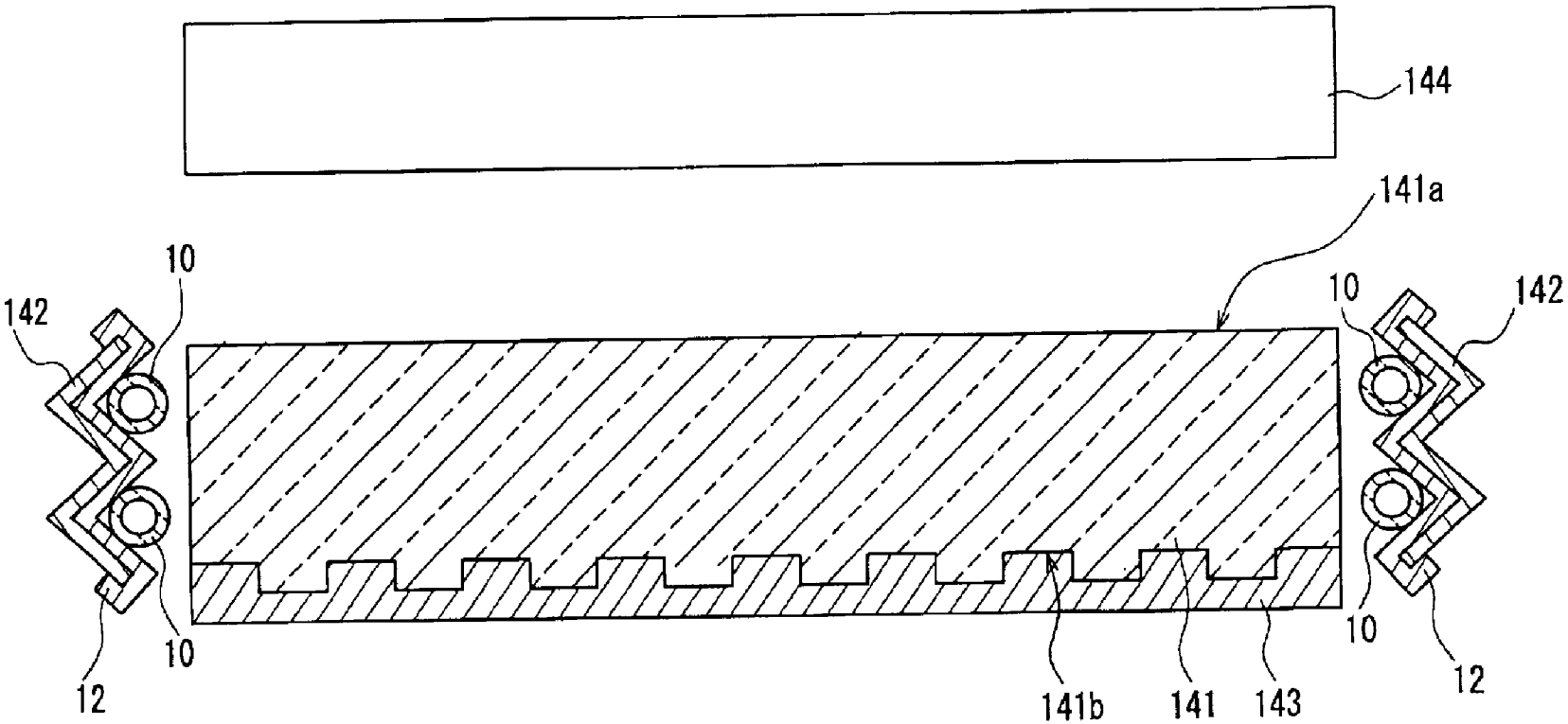
FIG. 11 is a cross-sectional view schematically illustrating an example of a liquid crystal display device employing a light source device of the present invention.

In Embodiment 5, still another example of a light source device of the present invention is described. FIG. 10 illustrates a light source device 140 according to Embodiment 5. FIG. 11 illustrates a cross section of the light source device 140 taken along a line XI—XI in FIG. 10. It should be noted that a liquid crystal panel 144 is illustrated also in FIG. 11.

The light source device 140 shown in FIG. 10 includes a light-guiding plate 141, supporting plates 142, and the light source devices 100. The discharge tubes 10 of the light source devices 100 are formed on the supporting plates 142. The supporting plates 142 have grooves, each having a V-shaped cross section, on which the discharge tubes 10 are fixed. The supporting plates 142 fix the discharge tubes 10 thereon and function as reflecting plates.

The discharge tubes 10 are arranged on sides of the light-guiding plate 141. The light-guiding plate 141 causes light emitted from the discharge tubes 10 to leave a front face 141*a* of the light-guiding plate 141 substantially uniformly. The light-guiding plate 141 can be made of, for instance, a transparent resin. A rear face 141*b* of the light-guiding plate 141 is corrugated so as to make the light leaving therefrom uniform. Additionally, a reflecting layer 143 is formed on the rear face 141*b*. The reflecting layer 143 can be made of, for instance, titanium oxide or a metal. Furthermore, a diffusing sheet or a lens sheet may be arranged on the front face 141*a* of the light-guiding plate 141 as required according to a condition of use.

The second electrode 12 of the light source device 140 is metal films formed on the supporting plates 142. The metal film and the outer surface of each discharge tube 10 are brought into contact with each other at two linear contact portions. The two linear contact portions are substantially parallel with each other, and are substantially parallel with the tube axis of the discharge tube 10.

In the case where the light source device 140 is used in a liquid crystal display device, the liquid crystal panel 144 is arranged above the light-guiding plate 141 as show in FIG. 11. In Embodiment 5, a planar light source and a liquid crystal display device in which the light source device 100 is employed are described. However, another light source device of the present invention may be used therein in place of the light source device 100.

Embodiment 6

Figure 12:
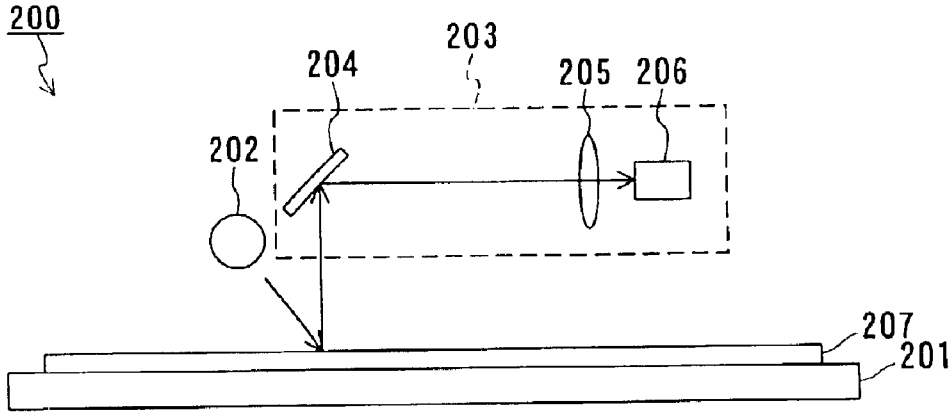
FIG. 12 is a view schematically illustrating a configuration of an example of an image reader of the present invention.

In Embodiment 6, an example of an image reader of the present invention is described. FIG. 12 schematically illustrates a configuration of an image reader 200 according to Embodiment 6.

The image reader 200 includes a stage 201, a light source device equipped with a discharge tube 202, and an optical system 203. The optical system 203 includes a mirror 204, a lens 205, and a photodetecting element 206.

A document is placed on the stage 201. The discharge tube 202 scans above the stage 201. The light source device 120 described in Embodiment 3 is applicable as the light source device including the discharge tube 202.

Light emitted from the light source device 120 is reflected by the document, thereby entering the optical system 203. The light having entered the optical system 203 is incident on the photodetecting element 206 (for example, charge coupled device) via the mirror 204 and the lens 205. The photodetecting element 206 outputs an electric signal according to an intensity distribution of the incident light. With this electric signal, the document can be read.

Figure 13:
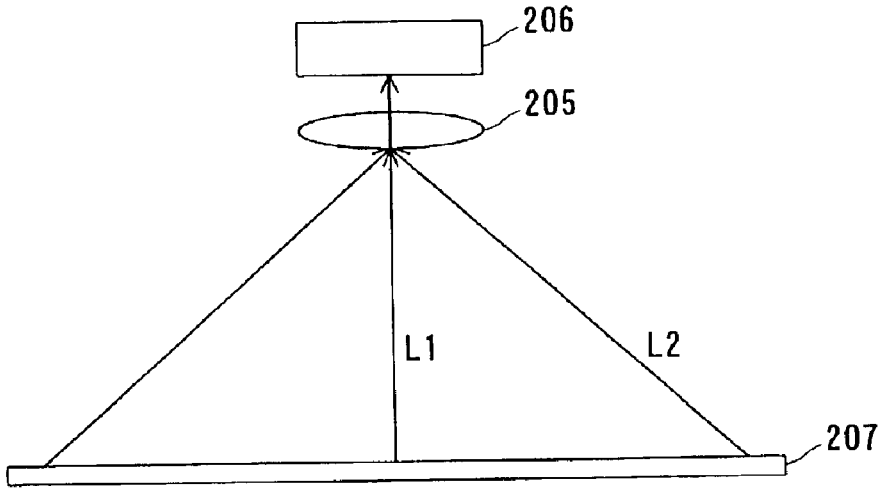
FIG. 13 is a view illustrating an optical path in the image reader.
Figure 14:
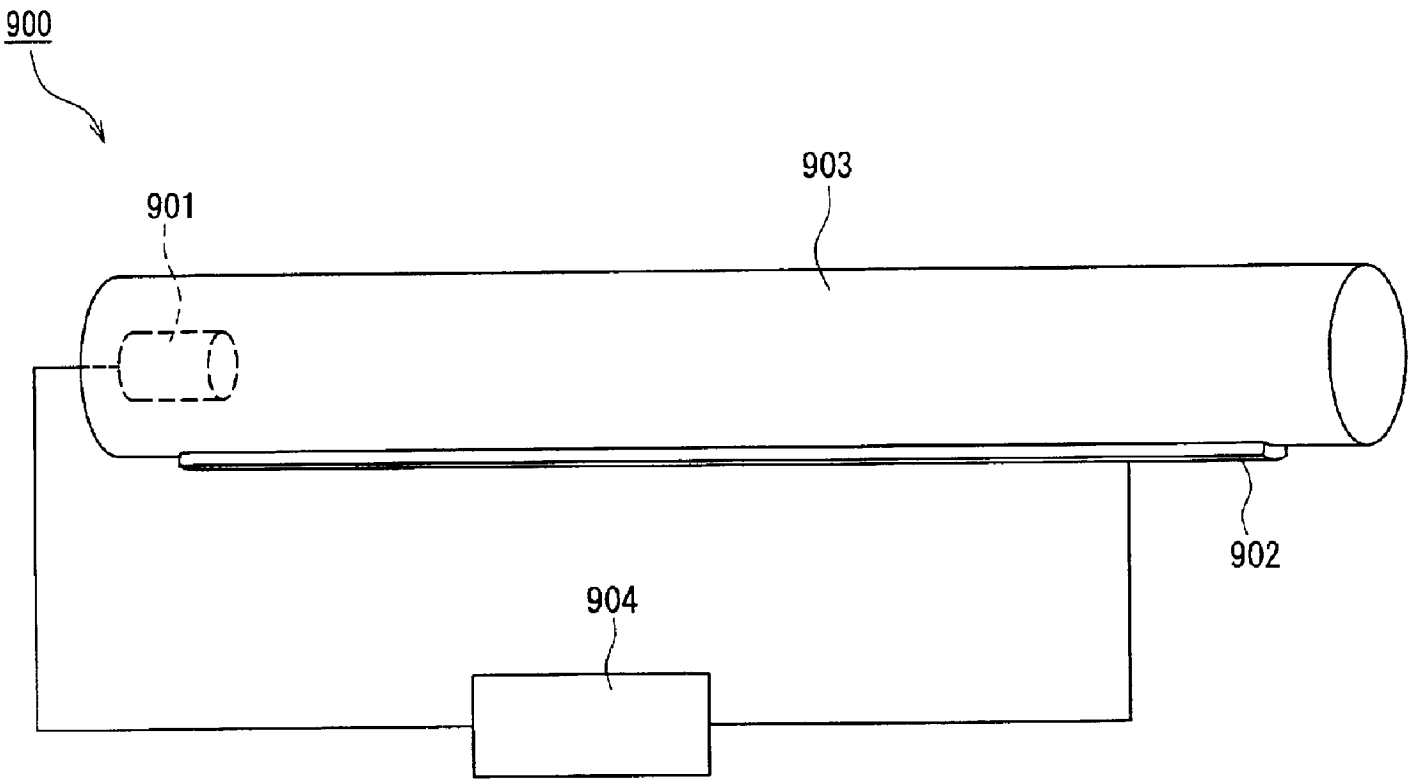
FIG. 14 PRIOR ART
FIG. 14 is a view schematically illustrating an example of a conventional light source device.
Figure 15B:
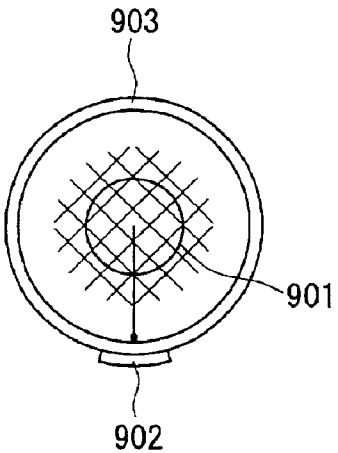
FIG. 15B PRIOR ART
FIG. 15B is a cross-sectional view of the same.
Figure 15A:
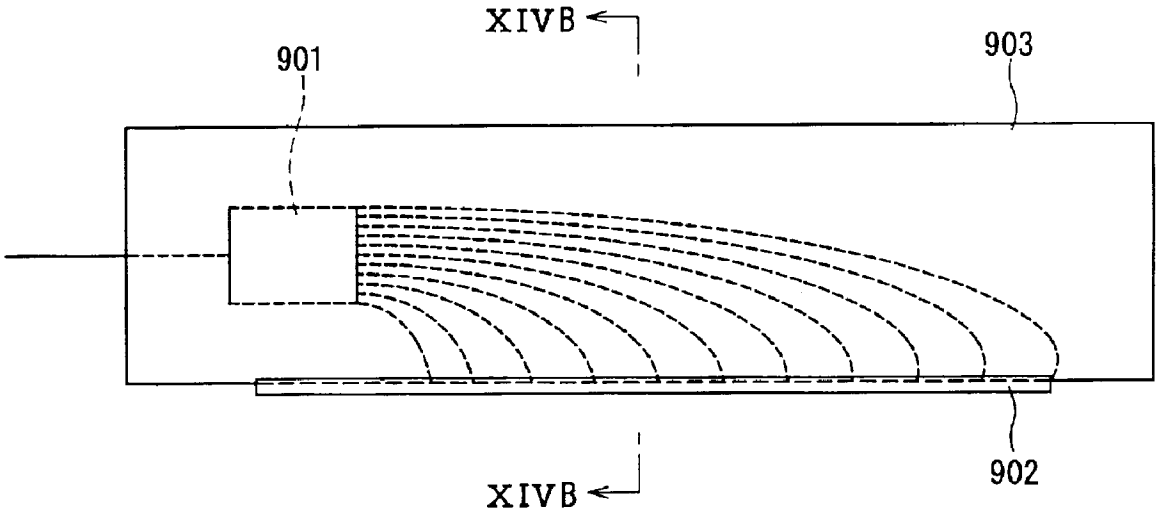
FIG. 15A PRIOR ART
FIG. 15A is a side view illustrating an example of a discharge state of the conventional light source device.
Figure 16B:
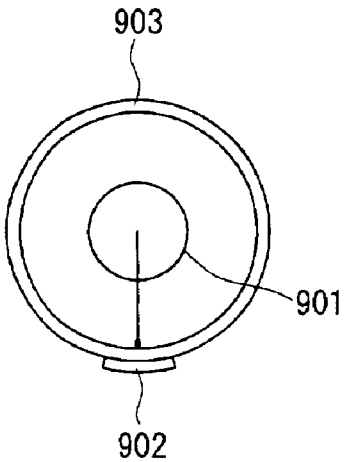
FIG. 16B PRIOR ART
FIG. 16B is a cross-sectional view of the same.
Figure 16A:
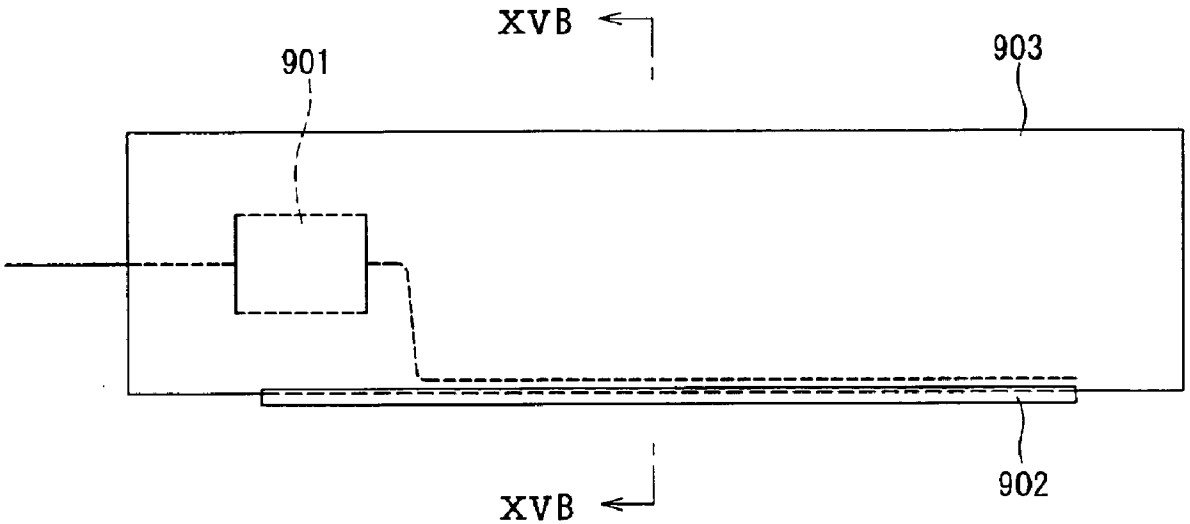
FIG. 16A PRIOR ART
FIG. 16A is a side view illustrating another example of a discharge state of the conventional light source device.
Figure 17B:
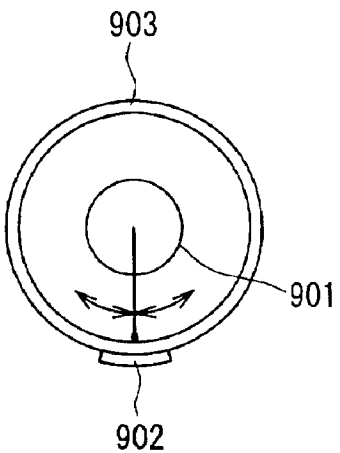
FIG. 17B PRIOR ART
FIG. 17B is a cross-sectional view of the same.
Figure 17A:
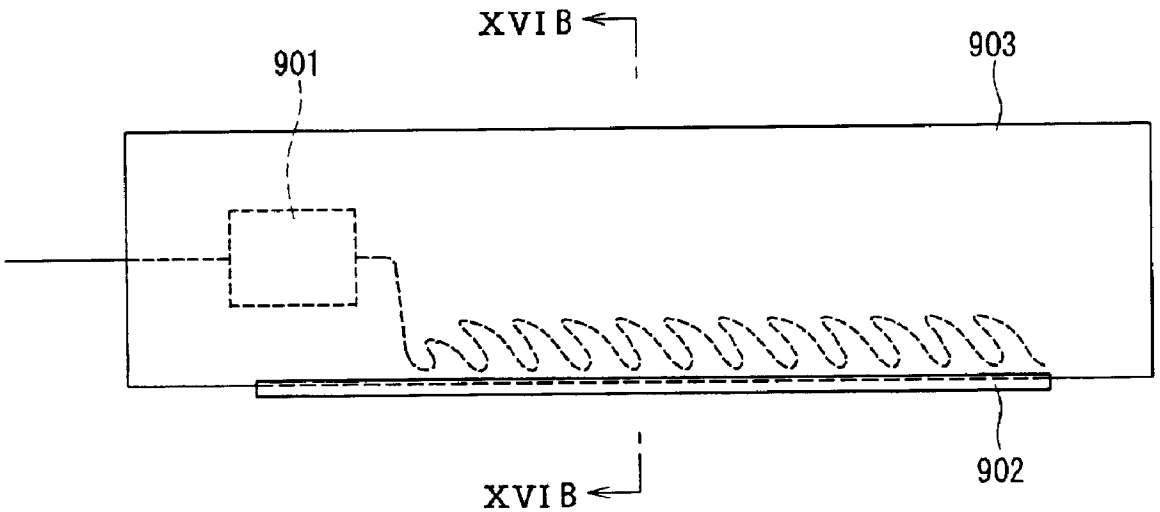
FIG. 17A PRIOR ART
FIG. 17A is a side view illustrating still another example of a discharge state of the conventional light source device.

The optical system 203 is an optical system that condenses and detects light reflected from the document (condensing optical system). An optical path in the optical system 203 is shown in FIG. 13. In the optical system 203, an optical path length L2 from a periphery of the document to the lens 205 is greater than an optical path length L1 from the center of the document to the lens 205. The light intensity is inversely proportional to the square of the distance. Therefore, in the case where the light reflected from the document has uniform intensity, an intensity of light having reached the photodetecting element 206 through the optical path having the length L2 is smaller than an intensity of light having reached the photodetecting element 206 through the optical path having the length L1. In a generally-used image reader, to ensure stable reading by correcting such an intensity distribution of light, the intensity of light from the center is attenuated so as to be consistent with the intensity of light from the periphery. However, such correction of light is not preferable since the light incident on the photodetecting element 206 is decreased. Therefore, it is preferable that in the light source device an intensity of light emitted from the center of the discharge tube is lower than an intensity of light emitted from the periphery of the discharge tube is used in an image reader in which a condensing optical system. With the light source device 120 according to Embodiment 3, it is possible to obtain light emission with an intensity distribution suitable for the optical system 203 by varying the space between the linear electrodes. This allows the image reader 200 to perform stable reading operations, thereby achieving a higher reading speed and a higher resolution. The image reader of the present invention is applicable in, for instance, a copying machine or a facsimile.

As described above, in the light source device of the present invention, by devising the arrangement of the outer electrode, the constricted discharge can be suppressed and the emitted light intensity distribution can be controlled. Even in the case where the gas pressure inside the discharge tube is high or the input power is high in particular, it is possible to suppress the constricted discharge. Therefore, the light source device of the present invention provides high-brightness light emission. Furthermore, since the light source device of the present invention includes a plurality of linear electrodes, the degradation of electrodes can be suppressed. Furthermore, in the light source device of the present invention, the brightness distribution can be controlled readily by varying the arrangement of the linear electrodes.

Thus, as described above, the present invention makes it possible to provide a light source device with which the occurrence of the constricted discharge can be suppressed readily and the light intensity distribution can be controlled readily. Furthermore, the use of the foregoing light source device in an image reader allows the image reader to exhibit high performances.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A light source device comprising:

at least one discharge tube;

a discharge medium sealed inside the discharge tube; and first and second electrodes for exciting the discharge medium, wherein the first electrode is arranged inside the discharge tube, the second electrode includes a plurality of linear electrodes, and the plurality of linear electrodes are arranged not in contact with each other but in contact with the outer surface of the discharge tube so as to be substantially parallel with each other.

2. The light source device according to claim 1, wherein the plurality of linear electrodes are arranged so as to be substantially parallel with a tube axis of the discharge tube.

3. The light source device according to claim 1, wherein the plurality of linear electrodes are arranged in a spiral form on the outer surface of the discharge tube.

4. The light source device according to claim 1, wherein a space between two selected from the plurality of linear electrodes is not less than a all thickness of the discharge tube.

5. The light source device according to claim 1, wherein a space between two selected from the plurality of linear electrodes decreases with increasing proximity to the first electrode.

6. The light source device according to claim 1, wherein a space between two selected from the plurality of linear electrodes is minimized at the center of the discharge tube.

7. The light source device according to claim 1, wherein the second electrode is in contact with the outer surface of the discharge tube via a dielectric.

8. The light source device according to claim 1, wherein the first electrode includes a protrusion that protrudes toward the second electrode.

9. The light source device according to claim 1, wherein the discharge medium contains at least one selected from xenon gas, krypton gas, argon gas, neon gas, and helium gas.

10. The light source device according to claim 9, wherein the discharge medium further contains mercury.

11. The light source device according to claim 1, wherein a pressure inside the discharge tube is not less than 6.65 kPa and not more than 26.6 kPa.

12. The light source device according to claim 1, further comprising a phosphor layer formed on an inner surface of the discharge tube.

13. The light source device according to claim 1, wherein a surface of the first electrode is covered with a dielectric.

14. An image reader for reading an image, the image reader comprising:

a light source device for emitting light; and an optical system for condensing and detecting the light reflected by the image, wherein the light source device is the light source device according to claim 6.

* * * * *